US008464753B2

(12) United States Patent
Schmidt et al.

(10) Patent No.: US 8,464,753 B2
(45) Date of Patent: Jun. 18, 2013

(54) VALVE ARRANGEMENT

(75) Inventors: Matthias Schmidt, Frankfurt (DE); Niels Wahlefeld, Neuss (DE); Franz-Josef Koerber, Altenstadt (DE)

(73) Assignee: ABB Technology AG, Zurich (CH)

( * ) Notice: Subject to any disclaimer, the term of this patent is extended or adjusted under 35 U.S.C. 154(b) by 571 days.

(21) Appl. No.: 12/722,686

(22) Filed: Mar. 12, 2010

(65) Prior Publication Data

US 2010/0243927 A1 Sep. 30, 2010

(30) Foreign Application Priority Data

Mar. 26, 2009 (DE) ..... 10 2009 014 421

(51) Int. Cl.
*F15B 13/04* (2006.01)

(52) U.S. Cl.
USPC ..... 137/596.15; 137/596.16; 137/596.14; 137/596.18

(58) Field of Classification Search
USPC ... 137/596, 596.1, 596.2, 596.14–18; 91/454, 91/457
See application file for complete search history.

(56) References Cited

U.S. PATENT DOCUMENTS

| | | | | |
|---|---|---|---|---|
| 3,036,598 | A * | 5/1962 | Smith et al. | 137/596.16 |
| 3,411,536 | A * | 11/1968 | Tennis | 137/596.15 |
| RE26,523 | E * | 2/1969 | Tennis | 91/454 |
| 3,452,779 | A * | 7/1969 | Klessig et al. | 137/596.14 |
| 3,561,489 | A * | 2/1971 | Furrer | 137/625.63 |
| 4,066,006 | A * | 1/1978 | Heiser | 91/433 |
| 4,343,972 | A * | 8/1982 | Bischofberger et al. | 200/81 R |
| 5,476,030 | A | 12/1995 | Plettner | |
| 5,484,352 | A * | 1/1996 | Kuma | 477/125 |
| 5,752,546 | A * | 5/1998 | Yamashita | 137/540 |
| 6,761,186 | B2 | 7/2004 | Heusser et al. | |
| 7,891,375 | B2 * | 2/2011 | Decker | 137/596.15 |

FOREIGN PATENT DOCUMENTS

| | | |
|---|---|---|
| DE | 3004599 A1 | 8/1981 |
| EP | 0373598 A2 | 6/1990 |

OTHER PUBLICATIONS

German Search Report dated Jun. 19, 2009 which issued during the prosecution of related German Patent Application No. 10 2009 014 421.8.

* cited by examiner

*Primary Examiner* — Craig Schneider
*Assistant Examiner* — Umashankar Venkatesan
(74) *Attorney, Agent, or Firm* — Leydig, Voit & Mayer, Ltd.

(57) ABSTRACT

A valve system for activating a piston of a piston-cylinder arrangement for a hydraulic or fluid device includes a pilot control valve including 3/2-way valve and a main valve arrangement having a first and a second main valve. The first and second main valves include 2/2-way valves, wherein in a first position the pilot-control valve is configured to move the first main valve into an open position so as to direct a path for a high pressure fluid to a space above the piston, and wherein in a second position the pilot-control valve is configured to connect the space to a low-pressure tank so as to relieve a pressure in the space above the piston via the second main valve, and wherein the pilot-control valve is configured to open the second main valve and configured to close the first main valve.

20 Claims, 3 Drawing Sheets

VALVE ARRANGEMENT

Priority is claimed to German Patent Application No. DE 10 2009 014 421.8, filed Mar. 26, 2009, the entire disclosure of which is incorporated by reference herein.

The invention relates to a valve arrangement.

BACKGROUND

Such valve arrangements are used to actuate piston-cylinder arrangements. The piston is located at one end of a piston rod, with the result that the cross-sectional area of the space above the piston is larger than the cross-sectional area below the piston since the cross-sectional area of the piston rod is subtracted from this cross-sectional area. If high-pressure fluid is then fed to the spaces above and below the piston, the piston moves in a first direction because the force applied to the upper side of the piston by the high-pressure fluid is larger owing to the larger cross-sectional area than the force applied to the underside of the piston. If the space above the piston is relieved of pressure while this space and the fluid contained therein are connected to a reservoir vessel, also referred to as a low-pressure tank, which is at low pressure the piston moves in a direction opposed to the first direction. The piston rod is therefore extended out of the cylinder when the space above the piston is acted upon, and is retracted again when the pressure is relieved.

Any fluid may be used as the medium. Hydraulic oil is generally used but also compressed air in specific cases. The hydraulic oil can be made available here by specific high-pressure tanks whose design is insignificant for the present invention.

Such piston-cylinder arrangements are used, in particular, for activating the movable contact piece of high-voltage power switches, and can, of course, also be used in other applications in which components such as, for example, crane arms, shovels of shovel excavators and the like are to be moved.

The connection of the space above and below the piston to the high-pressure tank and the connection of the space above the piston to the low-pressure tank or to other connections is brought about by means of mostly electrically actuated valves, using a 3/2-way valve or two 2/2-way valves, the latter operating independently of one another.

Depending on the application case, the intention is to be able to achieve, for example, switching over which is without switching losses and during which a volume flow from the pressure connection to the low-pressure tank via both control edges is to be avoided during the switching process, and also to be able to achieve a flow resistance or volume flow of different magnitudes depending on the switched position, a short switching time or activation with a small pilot-control volume.

However, when a 3/2-way valve is used these requirements can frequently only be met inadequately or with a high level of expenditure on manufacturing and high manufacturing costs. If two 2/2-way valves are used, during switching over the open valve must firstly be closed before the closed valve is opened if a switching loss is to be avoided. However, in the case of pilot-controlled valves this requires at least two pilot-control valves with a suitable electrical actuation system with, for example, delayed or sensor-controlled triggering of the second valve. This entails further high costs and an unnecessarily long delay of the opening of the second 2/2-way valve after the first closes.

SUMMARY OF THE INVENTION

An aspect of the present invention is to provide a valve system of the type mentioned at the beginning in which the above-mentioned requirements can be met with a low level of expenditure on manufacture and with low switching losses.

In this context, the invention is characterized in that the 3/2-way valve serves as a pilot-control valve for a valve arrangement having two main valves which are embodied as 2/2-way valves, wherein the pilot-control valve moves the first of the main valves into the open position in order to direct the high-pressure fluid to the piston-cylinder arrangement, wherein the second main valve, which clears a connection from the piston-cylinder arrangement to a low-pressure tank is closed, and said pilot-control valve actuates the second main valve to open and at the same time moves the first main valve into the closed position.

One advantageous embodiment of the invention with two main valves which each have a slide which is displaceably arranged within a valve body and has control faces to which pressurized fluid can be applied can be characterized in that each main valve respectively has three control faces, a first and a second control face of which respectively act on the slide in one direction, and the other third control face of which respectively acts on the slide in the other direction, wherein the sum of the two identically acting control faces is equal to the other control face acting in the opposite direction.

In this context, the control faces of each main valve each can correspond to an actuation element, wherein the surface area ratio of the third control face (third actuation element) to the second control face (second actuation element) of the second main valve is always greater than the surface area ratio of the third control face (third actuation element) to the first control face (first actuation element) of the first main valve.

It is particularly advantageous that the control faces can be formed by radially extending annular faces and/or radially extending end faces on the slides.

In particular, the valve system can be characterized in that the third control face of the first main valve is formed by the end face of the slide and is connected to the pilot-control valve.

Furthermore, the first and second control faces of the first main valve can be formed by annular faces, which are formed on the slide, and by an end face of the slide.

The second control face of the second main valve is formed here in a particularly advantageous way by an annular face which is arranged on the slide of the second main valve and is connected to the pilot-control valve.

The end faces of the slide of the second main valve are connected here as a third control face to the low-pressure tank.

High-pressure fluid can particularly advantageously be applied alternately to the first and third control face of each main valve via the pilot-control valve.

According to a further embodiment of the invention, the first control face of the first main valve is continuously connected to high pressure via a high-pressure feed line, and the first control face of the second main valve is continuously connected to low pressure.

In this context, the valve system can be characterized in that high pressure is applied to the second control faces of the first and second main valves when the first main valve is opened and the second main valve is closed, and low pressure is applied thereto when the first main valve is closed and the second main valve is opened.

Each main valve can respectively contain a helical compression spring which acts on the associated slide iii the closing direction. However, said helical compression springs are not necessary.

A further embodiment of the valve system can be characterized in that the slide of the second main valve has a longitudinal bore which passes completely through the slide, with the result that the space which accommodates the helical spring is connected to the end face and therefore to the low-pressure tank.

In a similar way, the valve system can be characterized in that the slide of the first main valve has a longitudinal bore which passes partially through the slide and which connects the space for accommodating the helical compression spring to a duct in the interior of the first main valve, which duct is connected to the piston-cylinder arrangement.

In this context, the control faces of each main valve each can correspond to an actuation element, wherein the surface area ratio of the third control face (third actuation element) to the second control face (second actuation element) of the second main valve is always greater than the surface area ratio of the third control face (third actuation element) to the first control face (first actuation element) of the first main valve.

Therefore, the surface area ratios of the control faces on the slides of the main valves are configured in such a way that a significantly higher pilot-control pressure is required to open the first main valve than to close the second main control valve. A sufficiently large flow resistance in the region of the pilot-control valve in relation to the flow resistances in the line sections leading from the pilot-control valve to the main valves ensures that when the pilot-control valve switches the pilot-control volume flow is always firstly implemented through the still open main valve, while the latter is closing, and the pilot-control pressure does not change significantly in the process. Only after the possibly still open main valve has closed does said main valve no longer implement any volume flow, with the result that the pilot-control pressure increases further, or in a different case decreases until the other main valve opens.

In this context, as a result of the rising pilot-control pressure, the second main valve is firstly closed, and the first main valve then opened, whereas when the pilot-control pressure is dropping the first main valve firstly closes and then the second main valve opens. As a result, the desired switching behaviour is achieved by means of actuation by a single common pilot-control valve without a need for separate, chronologically offset actuation of the main valves.

While the control face sums and ratios according to the invention are complied with at each slide of the main valves, diameters of each main valve and further parameters can be selected freely within wide limits independently of the other main valve.

In the case of leakage or if a volume flow occurs from the consumer, that is to say a piston-cylinder arrangement, the main valves can open automatically. Furthermore, automatic closing occurs if no further volume flow is required by the consumer, for example because a connected working piston has moved into its end position.

If the consumer docs not implement any volume flow, an immediate opening of the main valve is made possible when the pilot-control valve switches over without a delay due to the closing of the other main valve.

Owing to the ratios of the control faces, the hydraulic forces on the first main valve cancel one another out as soon as the same pressure prevails at the connection directed towards the consumer as at the connection directed to the pressure supply. As soon as the consumer-side pressure drops, the first main valve is opened again when the slide is in the closed position, for example due to a compression spring. In a corresponding way this also applies to the second main valve.

The invention, further advantageous embodiments of the invention and further advantages will be explained and described in more detail on the basis of the drawing in which a valve arrangement according to the invention is illustrated schematically.

DETAILED DESCRIPTION

Figure 1:
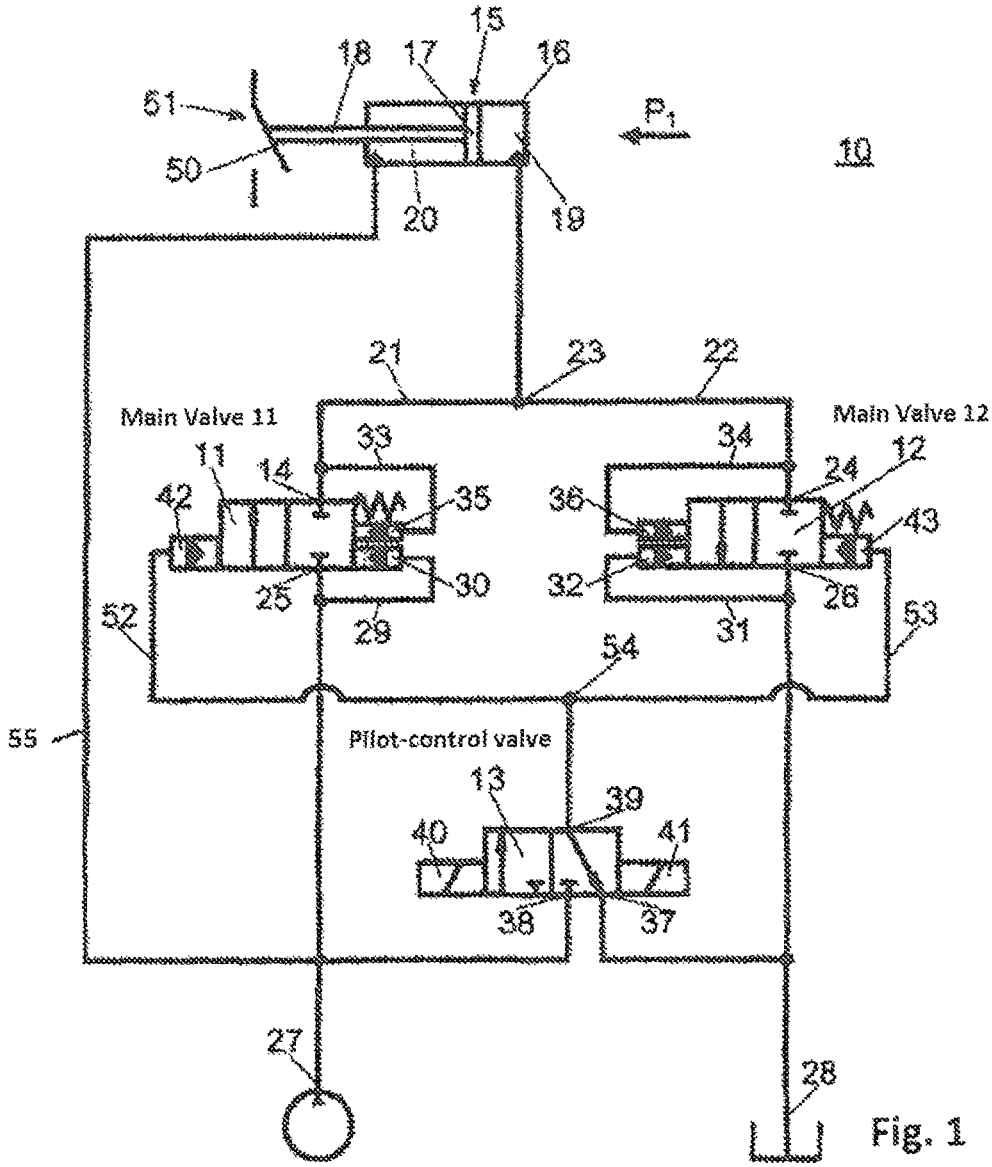
FIG. 1 is a switching diagram of a valve arrangement.

FIG. 1 is a schematic switching diagram of a valve arrangement 10 with two main valves 11 and 12 and a pilot-control valve 13. The two main valves 11 and 12, also referred to below for short as first and second valves 11, 12, are 2/2-way valves with different designs, as will be explained in more detail further below. The one outlet 14 of the first valve 11 is connected via a connecting line 21 with a piston-cylinder arrangement 15 which has, in a cylinder housing 16, a piston 17 on which a piston rod 18 is integrally formed. The outlet 14 is connected here to the space 19 above the piston 17. The space 20 below the piston 17 is connected to a high-pressure supply 27 via a line 55, but this is not significant for the functionality since the restoring force of the piston 17 can also be applied differently, for example, by means of a spring. Owing to the different cross sections of the spaces below and above the piston 17, if high-pressure fluid is applied to both spaces 19 and 20 a force acts on the piston 17 and drives it out of the cylinder 16 in the direction P1 of the arrow. In the process, the movable switching contact piece 50 of a high-pressure power switch 51 can be connected to the piston rod 18, with the result that the switch can be switched on and off by actuating the two valves 11 and 12. In the position illustrated here, the switch 51 which is opened here would be closed if high-pressure fluid is present in the spaces 19 and 20; for the switching-off process, the space 19 above the piston 17 would be relieved of pressure, with the result that the fluid located in the space 20 below the piston 17 pulls the piston 17 counter to the direction P1 of the arrow, and therefore pulls the piston rod 18 into the cylinder 16. The application in a switch is merely exemplary.

However, a further connecting line 22 is connected to the connecting line 21 at a node point 23, said further connecting line 22 being coupled to an output opening 24, referred to for short as opening or outlet 24, which is also closed in the position shown here. The outlet 24 is located on the second valve 12.

The two valves 11 and 12 each have a further opening or outlet 25 and 26, of which the opening 25 of the valve 11 is connected to a high-pressure supply 27, which can be a high-pressure accumulator or a pump, and of which the opening 26 of the valve 12 is connected to a low-pressure tank 28, which is represented only symbolically here. The opening 25 is connected via a return line 29 to a first actuation element 30 of the valve 11, and the opening 14 is connected via a return line 33 to a second actuation element 35 of the valve 11. The opening 26 is connected via a return line 31 to a first actuation element 32 of the valve 12, and the opening 24 is connected via a return line 34 to a second actuation element 36 of the valve 12.

The two valves 11 and 12 which are embodied as 2/2-way valves are assigned the pilot-control valve 13 which is embodied here as a 3/2-way valve. It has openings 37, 38 and 39. The opening 38 is connected here to the high-pressure supply 27, and the opening 37 to the low-pressure tank 28. The opening 39 can be connected either to the high-pressure supply 27 or to the low-pressure tank 28 by activating an electromagnetic controller 40 and 41 or by some other kind of external application of force. The outlet opening 39 is connected via a node point 54 to lines 52 and 53, each with a third actuation element 42 and 43 of the valves 11 and 12. The third actuation element 42 of the valve 11 serves to move the valve 11 into its opened position when the connection 39 of the pilot-control valve 13 is connected to the high-pressure supply 27. The third actuation element 43 of the valve 12 serves to close the second valve 12 when the connection opening 39, or else for short the connection 39, of the pilot-control valve 13 is connected to the high-pressure supply 27. It is to be noted here that the term "connection opening" in the text which follows is also referred to for short as "connection". In this way, the space 19 below the piston 17 is connected to the high-pressure supply 27, and the piston 17 moves out of the cylinder housing 16. If the connection 39 of the pilot-control valve 13 is connected to the low-pressure tank 28, the pressure also drops at the third actuation elements 42 and 43. As a result, the first actuation element 30 can close the first valve 11, and the second actuation element 36 can open the second valve 12. As a result, the space 19 above the piston 17 is connected to the low-pressure tank 28, and the piston 17 moves into the cylinder housing 16.

The actuator elements 30, 35, 32, 36 and the actuator elements 42 and 43 are described further below in terms of design and method of operation in conjunction with FIGS. 2 and 3, where the term "actuation element" is also explained.

Figure 2:
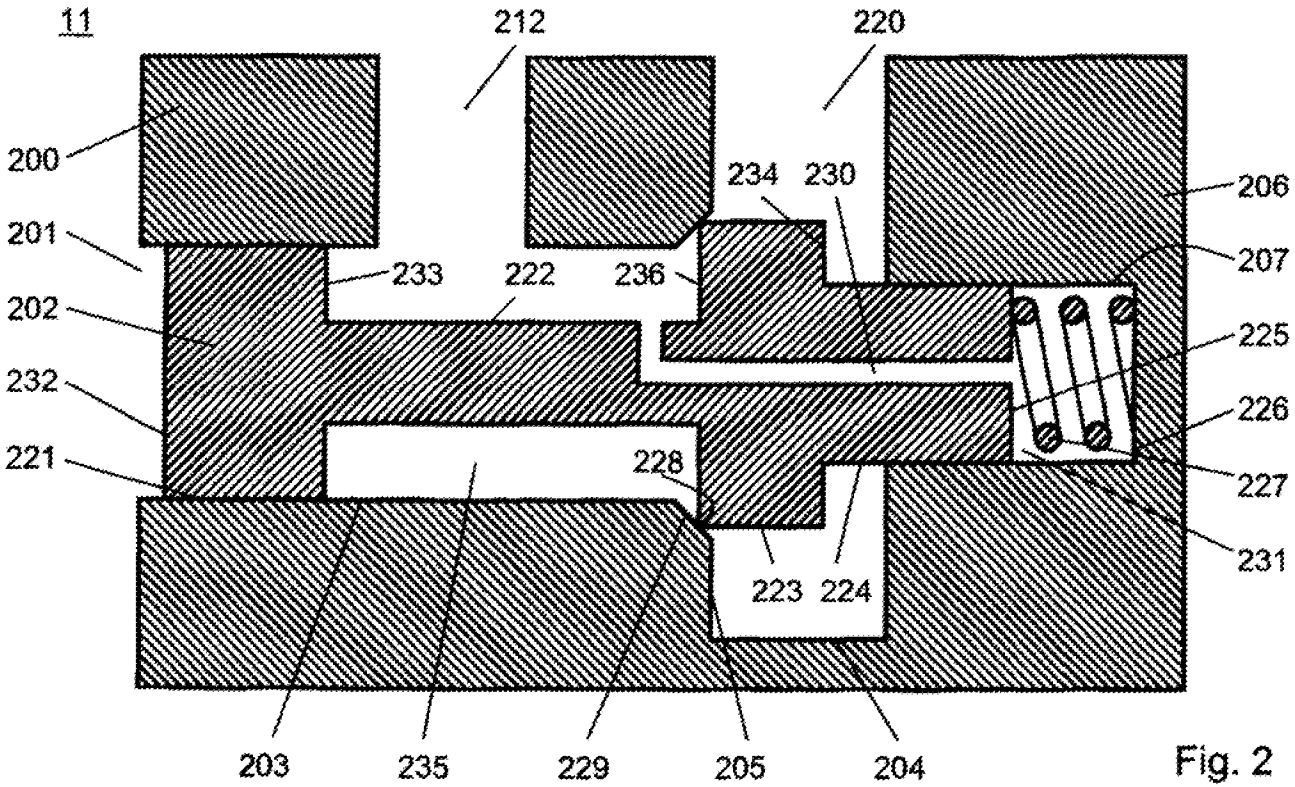
FIG. 2 is a sectional view of the first main valve of the arrangement according to FIG. 1 in a schematic illustration.

Reference will now be made to FIG. 2.

The valve 11 has a valve body 200 which surrounds an interior space 201 in which a slide 202 can move in a sliding fashion. The interior space 201 has a first interior space section 203 and a second interior space section 204 which has an internal diameter which is enlarged compared to that of the interior space section 203. The two interior space sections 203 and 204 are connected to one another via a radial annular face 205 which forms a step. The second interior space section 204, also referred to for short as second section, is closed off by a base 206 which has a depression 207, see below.

A region 229, which acts as a sealing face and is represented in this case as a bevelled chamfer is located between the first interior space section 203 and the annular face 205.

The valve body 200 has, approximately in the central region, a bore 212 which engages radially through the valve body 200 and opens into the space 201. A further bore 220, which extends perpendicularly with respect to the longitudinal extent of the valve body 200, opens into the region of the section 204 of the valve body 200.

The slide 202 is mounted in a slideable fashion within the valve body 200. Said slide 202 has a first slide section 221, the external diameter of which corresponds to the internal diameter of the section 203, a second slide section 222, the external diameter of which is smaller than the external diameter of the first section 203 and is dimensioned in such a way that fluid can flow through, a third slide section 223, which is slightly larger than the internal diameter of the section 203 with the result that a seal can be produced at the sealing face 229 when the slide 202 is pressed entirely to the left (in the drawing), and a fourth slide section 224, the external diameter of which corresponds to the internal diameter of the depression 207 and is smaller than the external diameter of the slide section 221 but larger than the external diameter of the slide section 222. The fourth slide section 224 engages continuously in the depression 207, i.e. in each position of the slide 202, and the slide section 221 also engages continuously in the slide section 203. In the depression 207 between the end face 225, located in the depression 207, of the slide 202 and the base 226 of the depression 207, a helical compression spring 227 is arranged in a spring-receptacle space 231 formed between said end face 225 and said base 226, which helical compression spring 227 is supported by one of its ends against the end face 225 and by its other end against the base 226 of the depression 207 and presses the slide 202 to the left (in the drawing), with the result that the slide section 223 bears or is pressed with its sealing edge 228 facing the chamfer 229 against the chamfer 229 which acts as a sealing face. It is illustrated here that the inner edge of the annular face 205 has a chamfer with the result that the sealing edge 228 of the slide 202 is pressed against the chamfer 229, for example here by the force of the helical compression spring 227, and therefore forms a seal. Of course, the sealing edge 228 could also have a chamfer and come to bear on an inner edge, which does not have a chamfer or has a chamfer at a different angle, between the section 203 and the annular face 205, which could be a variant. Any other way of embodying a sealing contact would also be conceivable.

Taking the second slide section 222 up to the end face 225 as a basis, an inner bore 230 extends within the slide 202 with the result that the space 235 is connected, in the region of the second slide section 222, to the spring-receptacle space 231 in which the spring 227 is located. If high-pressure fluid is located in the space 235 in the region of the second slide section 222, the pressure will also be present in the spring-receptacle space 231 with the spring 227, and, owing to the dimensions, will support the force of the helical compression spring 227 and press the slide 202 with the third slide section 223 with respect to the annular face 205 or the chamfer 229.

The element denoted as the third triggering element 42 acts as a third control face which is formed by the free end face 232 of the slide 202.

The second triggering element 35 acts as a second control face, which is formed by the annular faces 233, 236 and the end face 225 on the slide 202, which annular faces 233 and 236 are located between the slide sections 221 and 222, and respectively the slide sections 222 and 223. The first triggering element 30 acts as a first control face which is formed via the annular face 234 between the slide sections 223 and 224. Here, the end face 232 is of equal size to the sum of the annular faces 233, 234 and of the end faces 225 minus the annular face 236, with the result that if the main valve 11 is under high pressure like the line 52, the slide 202 is pressed against the sealing face or chamfer 229 exclusively by the force of the spring 227. The helical compression spring 227 would not be necessary for the function here and could therefore also be omitted; it merely supports the switching process, see further below; the slide 202 would be freely movable in the valve body because the forces are all in equilibrium.

The pilot-control valve 13 is connected to the third triggering element 42 of the first valve 11 via the connecting line 52, wherein the pressurized fluid which is present in the connecting line 52 acts on the free end face 232 of the slide 202.

The following is also to be noted: the first actuation element 30 therefore corresponds to the first control face, the second actuation element 35 corresponds to the second control face, and the third actuation element 42 corresponds to the third control face, in each case of the first valve 11.

Figure 3:
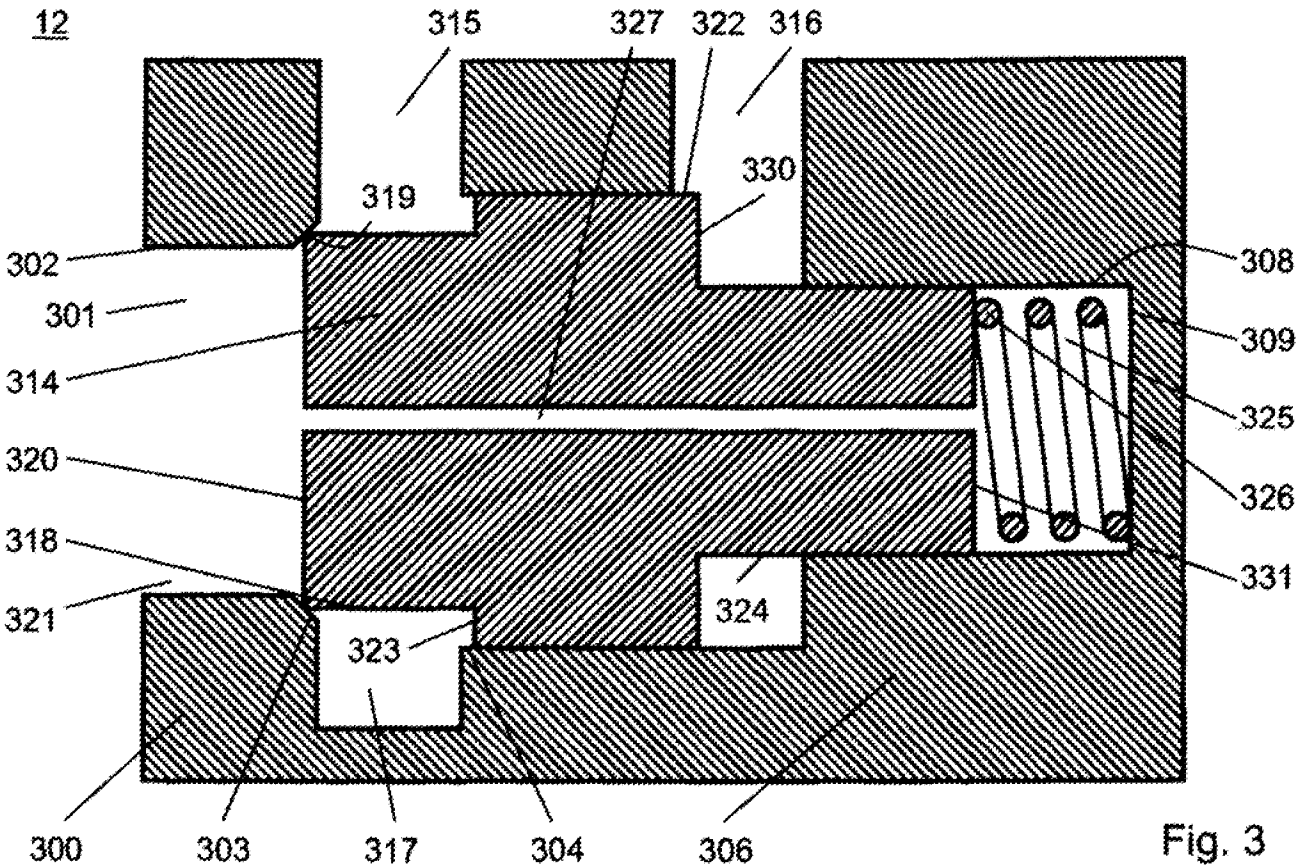
FIG. 3 is a sectional view of the second main control valve of the arrangement in FIG. 1, likewise in a schematic illustration.

Reference will now be made to FIG. 3.

FIG. 3 shows a schematic longitudinal sectional diagram of the main valve 12. The latter has a valve body 300, the interior 301 of which has a plurality of sections with different internal diameters, and the end which is on the left in the drawing is adjoined by a first section 302, which, via a conical stage or chamfer 303 which opens at the other end of the valve body 300, merges with a second section 304 with a slightly larger diameter with an intermediate internal duct 317. The section 304 is adjoined by a base section 306 in which a depression 308 is formed, said depression 308 closing off the valve body 300 at this end.

The valve body 300 has two bores 315 and 316 which extend transversely with respect to its longitudinal axis, the first bore 315 of which opens into the internal duct 317 between the first and second sections 302 and 304. The second bore 316 opens into the part of the section 304 which faces the base section. The first bore 315 is therefore located in the region of the plane of transition from the first section 302 to the second section 304 of the valve body 300, with the interior space 317 adjoining the conical stage 303. The bore 215, which corresponds to the opening 24, is assigned to the line 22, and the second bore 316 is assigned to the third actuation element 43.

A slide 314 is accommodated within the valve body 300, which slide 314 has a first section 318, the external diameter of which is slightly larger than the internal diameter of the first section 302 of the valve body 300, with the result that the slide 314 can abut with its end edge or sealing edge 314 against the conical stage 303 when the slide 314 is in the position shown in FIG. 3. The external diameter of the section 318 is to be dimensioned in such a way that when the sealing edge is opened sufficient fluid can flow through. As a result, the slide 314 seals the annular space 317 against the region 321, lying in front of the end face 320 adjoining the sealing edge 319, within the first section 302 of the valve body 300, to which region 321 the low-pressure tank 28 is connected. The sealing contact, composed of the chamfer 303 and 319, can also have a different geometric design, which is insignificant for the functionality of the system.

The first section 318 of the slide 314 is adjoined by a second section 322 with a larger external diameter, as a result of which a step 323 which points to the end face 320 is formed, and to which step 323 the pressurized fluid which is present in the annular space 317 applies a force which presses the slide 314 against the base face 309 of the depression 308 of the valve body 300.

The second section 322 of the slide 314 is adjoined by a third section 324 with which the slide 314 engages in the interior of the depression 308. In the space 325, also referred to as the spring-receptacle space, between the slide 314 and the end face 331 thereof and the base 309, a helical compression spring 326 is located, which helical compression spring 326 presses the slide 314 with its sealing edge 319 against the conical face or conical step 303. The external diameter of the third section 324 is smaller than that of the first section 318.

The slide 314 has a longitudinal bore 327 which extends in its longitudinal direction and which opens into the end faces 320 and 331, and therefore into the space 325, and therefore connects the spaces 321 and 325 to one another. Low pressure is present continuously at the space 321 since the latter is connected to the low-pressure accumulator 28. Accordingly, the connection 26 is equal to the space 321.

The junction between the sections 322 and 324 is formed by an annular face 330.

The second control face, formed by the annular face 323, corresponds, in the switching diagram in FIG. 1, to the second actuation element 36, and the third control face, formed by the annular face 330, corresponds to the third actuation element 43; the first control face, corresponding to the first actuation element 32, is formed by the difference between the end faces 320 and 331.

The method of functioning of the valve arrangement is as follows:

It is assumed that pressurized fluid is to be applied to the space 19 above the piston 17 in order to move the piston rod 18 out of the cylinder 16. For this purpose, the pilot-control valve 13 is actuated in such a way that fluid under high pressure is fed via the line 53 to the actuation element 43 and therefore to the annular face 330 of the slide 314. The slide 314 is therefore moved to the left, as a result of which the connections 24 and 26 are disconnected by pressing the edge 319 onto the chamfer 303, which is assisted by the compression spring 227. At the same time, the pressurized fluid passes via the line 52 to the third actuation element 42 of the first valve 11, which corresponds to the end face 232 of the slide 202, and pushes the slide 202 counter to the pressing force which acts on the slide 202 by means of the first actuation element 30 of the first valve 11, and the force of the compression spring 227 to the right (in the drawing) with the result that the sealing edge 228 lifts off from the sealing face 229 and the connection 25 is connected to the connection 14, with the result that fluid under high pressure passes to the space 19 above the piston 17 and the piston 17 moves out of the cylinder 16.

If the pressure in the space above the piston 17 is to be relieved, the pilot-control valve 13 is switched over with the result that fluid at low pressure is present at the connection 39, with the result that the force acting on the first actuation element 30 from the fluid under high pressure pushes the slide 202 to the left, and therefore disconnects the connections 25 and 14 as a result of the contact of the sealing edge 228 and the sealing face 229. At the same time, the third actuation element 43 of the second valve 12 is connected to the low-pressure accumulator 28 via the line 53, with the result that the slide 314 is pushed to the right counter to the force of the compression spring 326 by the force with which acts from the pressure in the line 22 and 34 on the second actuation element 36 in the form of the annular face 323 of the second valve 12, and as a result the connections 24 and 26 are connected. The fluid can therefore flow out of the space 19 above the piston 17 to the low-pressure accumulator 28 via the connections 24, 26, and the force which acts on the piston 17 to the right, for example as a result of the pressure from the high-pressure supply being applied to the space 20, moves the piston 17 into the cylinder 16.

The inventive configuration of the surface area ratios ensures that one main valve 11 or 12 is always closed before the respective other valve can be opened, without chronologically offset actuation of the two main control valves 11, 12 becoming necessary. In order to achieve this, it is necessary to ensure that the surface area ratio of the third actuation element 43 of the second valve 12 and (with respect to) of the second actuation element 36 of the second valve 12 is always larger than the surface area ratio of the third actuation element 42 of the first valve 11 and (with respect to) of the first actuation element 30 of the first valve 11.

The slides each have a longitudinal bore, as mentioned above, wherein the longitudinal bore 230 on the slide 202 of the first main valve 11 is connected to the space of the first main valve 11 which, in terms of flow is located downstream of the control edge, i.e. downstream of the sealing edge 228/229, with respect to the face turned towards the piston-cylinder arrangement 15. This ensures that the pressure which drops behind the sealing edge 228/229 also drops at the end face 225 acting as a compensation face, as a result of which an opposing force is generated, which acts in the opening direction and partially compensates the flow force acting in the closing direction. The same also occurs in the second main control valve 12 insofar as the pressure in the space upstream of the end face 320 is equal to the pressure at the end face 331.

The inventive disconnection of the sealing points or control edges into the control edges located in the first main valve and those located in the second main valve permits the two control edges to be configured in terms of diameter, flow behaviour and further features in a way which is appropriate for demand. As a result, while the respective suitable control face ratios are complied with at each slide, the diameter and various further parameters can be freely selected within wide limits independently of the other main valve.

A particular advantage of the invention is that, when the two compression springs 326 and 227 are used, the two main valves 11 and 12 close again after the ending of the movement of the piston 17 by virtue of the forces which are applied. This permits immediate opening of the necessary main valve during the subsequent switching of the pilot-control valve without a delay as a result of the previous closing of the other main valve if the switching over takes place at a time at which there is no volume flow implemented at the consumer. This is achieved by virtue of the fact that the two control faces on one side of a main valve are each precisely of the same magnitude as the individual control face acting in the opposite direction. As a result, the hydraulic forces at the main valve cancel one another out as soon as the same pressure is present at all the connections. If leakages were to have occurred in the stationary state which, depending on the position of the piston 17, leads to a drop in pressure or increase in pressure in the piston space 19, the main valves can open automatically and compensate these leakages. As a result, the piston always remains in the desired position when the pilot-control valve 13 is not activated.

The inner faces of the valve bodies in which outer faces of the slide can be dimensioned as a duct seal, and there is of course also the possibility of using annular seals here.

List of Reference Numerals

10 Valve arrangement
11 First main valve, first valve
12 Second main valve, second valve
13 Pilot-control valve
14 First outlet
15 Piston-cylinder arrangement
16 Cylinder housing
17 Piston
18 Piston rod
19 Space above the piston
20 Space below the piston
21 Connecting line
22 Further connecting line
23 Node point
24 Outlet opening, opening, outlet, connection to the second main valve
25 Further opening, outlet, at the first main valve
26 Further opening, outlet, at the second main valve
27 High-pressure supply
28 Low-pressure tank
29 Return line
30 First actuation element of the valve 11
31 Return line
32 First actuation element of the valve 12
33 Return line
34 Return line
35 Second actuation element of the valve 11
36 Second actuation element of the valve 12
37 Opening
38 Opening
39 Opening, each on the pilot-control valve 13
40 Electromagnetic controller
42 Third actuation element of the valve 11
43 Third actuation element of the valve 12
50 Movable contact element
51 High-voltage power switch
52 Line
53 Line
54 Node point
55 Connecting line
200 Valve body
201 Interior space
202 Slide
203 First interior space section
204 Second interior space section
205 Annular face
206 Base
207 Depression
221 First slide section
222 Second slide section
223 Third slide section
224 Fourth slide section
225 End face
220 Base
227 Helical compression spring
228 Sealing edge
229 Sealing face
230 Internal bore
231 Spring-receptacle space
232 End face
233 Annular face
234 Annular face
235 Space in the region of the second slide section 222
236 Annular face
300 Valve body
301 Interior space
302 First section
303 Conical stage, chamfer
304 Second section
306 Base section
308 Depression
314 Slide
315 First bore
316 Second bore
317 Internal duct, annular space
318 First section of the slide 314
319 End edge or sealing edge
320 End face
321 Region upstream of the end face 320
322 Second section
323 Annular face
324 Third section
325 Spring-receptacle space
326 Helical compression spring
327 Longitudinal bore

What is claimed is:

1. A valve system for activating a piston of a piston-cylinder arrangement, the piston being configured to activate a movable contact piece of a high-voltage power switch, the valve system comprising:

a pilot control valve including 3/2-way valve; and a main valve arrangement including a first main valve and a second main valve, wherein the first and second main valves include 2/2-way valves, wherein in a first position the pilot-control valve is configured to move the first main valve into an open position so as to direct a path for a high pressure fluid to a space above the piston, wherein in a second position the pilot-control valve is configured to connect the space to a low-pressure tank so as to relieve a pressure in the space above the piston via the second main valve, wherein the pilot-control valve is configured to open the second main valve and configured to close the first main valve, wherein the first and the second main valves each include a valve body, a slide, which is displaceably arranged within the valve body, and a plurality of control faces, wherein each control face comprises one or more annular surfaces, wherein a pressurized fluid is configured to be applied to the plurality of control faces, wherein the plurality of control faces include a first control face and a second control face acting on the slide in one direction and a third control face acting on the slide in another direction, such that a sum of a force from the first control face and a force from the second control face is equal to a force from the third control face, and wherein the first control face of the second main valve includes a first and a second end face and is connected to the low-pressure tank.

2. The valve system as recited in claim 1, wherein each of the plurality of control faces correspond to an actuation element, such that a surface area ratio of the third control face to the second control face of the second main valve is always greater than a surface area ratio of the third control face to the first control face of the first main valve.

3. The valve system as recited in claim 1, wherein the second control face of the second main valve is formed by an annular face disposed on the slide and connected to the pilot-control valve.

4. The valve system as recited in claim 1, wherein the high-pressure fluid is configured to be applied alternately to the first and third control faces of the first main valve via the pilot-control valve, and wherein the high-pressure fluid is configured to be applied alternately to the first and third control faces of the second main valve via the pilot-control valve.

5. The valve system as recited in claim 1, wherein the first control face of the first main valve is continuously connected to a high pressure via a high-pressure feed line, and wherein the first control face of the second main valve is continuously connected to a low pressure.

6. The valve system as recited in claim 1, wherein a high pressure is configured to be applied to the second control faces of the first and the second main valves when the first main valve is opened and the second main valve is closed, and wherein a low pressure is configured to be applied to the second control faces of the first and the second main valves when the first main valve is closed and the second main valve is opened.

7. The valve system as recited in claim 1, wherein each of the first and the second main valves contain a helical compression spring acting on the slide in a closing direction.

8. The valve system as recited in claim 1, wherein the slide of the second main valve includes a longitudinal bore passing completely through the slide such that a space accommodating the helical spring is connected to the first end face and to the low-pressure tank.

9. The valve system as recited in claim 1, wherein the slide of the first main valve has a longitudinal bore passing partially through the slide and connecting a space accommodating the helical compression spring to a duct in an interior of the first main valve, wherein the duct is connected to the piston-cylinder arrangement.

10. The valve system as recited in claim 1, wherein each of the plurality of control faces are formed by at least one of a radially extending annular face and a radially extending end face disposed on the slide.

11. The valve system as recited in claim 10, wherein the third control face of the first main valve is formed by a first end face and is connected to the pilot-control valve.

12. The valve system as recited in claim 10, wherein the first and second control faces of the first main valve are formed by a plurality of annular faces integrally formed on the slide and by the end face.

13. A valve system for activating a piston of a piston-cylinder arrangement for a hydraulic or fluid device, the valve system comprising:

a pilot control valve including a 3/2-way valve; and a main valve arrangement including a first main valve and a second main valve, wherein the first and second main valves include 2/2-way valves, wherein in a first position the pilot-control valve is configured to move the first main valve into an open position so as to direct a path for a high pressure fluid to a space above the piston, wherein in a second position the pilot-control valve is configured to connect the space to a low-pressure tank so as to relieve a pressure in the space above the piston via the second main valve, wherein the pilot-control valve is configured to open the second main valve and configured to close the first main valve, wherein the first and the second main valves each include a valve body, a slide, which is displaceably arranged within the valve body, and a plurality of control faces, wherein each control face comprises one or more annular surfaces, wherein a pressurized fluid is configured to be applied to the plurality of control faces, wherein the plurality of control faces include a first control face and a second control face acting on the slide in one direction and a third control face acting on the slide in another direction, such that a sum of a force from the first control face and a force from the second control face is equal to a force from the third control face, and wherein each of the plurality of control faces correspond to an actuation element, such that a surface area ratio of the third control face to the second control face of the second main valve is always greater than a surface area ratio of the third control face to the first control face if the first main valve.

14. The valve system as recited in claim 13, wherein the second control face of the second main valve is formed by an annular face disposed on the slide and connected to the pilot control valve.

15. The valve system as recited in claim 13, wherein the first control face of the second main valve includes a first and a second end face and is connected to the low-pressure tank.

16. The valve system as recited in claim 13, wherein the high-pressure fluid is configured to be applied alternately to the first and third control faces of the first main valve via the pilot-control valve, and wherein the high-pressure fluid is configured to be applied alternately to the first and third control faces of the second main valve via the pilot-control valve.

17. The valve system as recited in claim 13, wherein the first control face of the first main valve is continuously connected to a high pressure via a high-pressure feed line, and wherein the first control face of the second main valve is continuously connected to a low pressure.

18. The valve system as recited in claim 13, wherein each of the plurality of control faces are formed by at least one of a radially extending annular face and a-radially extending end face disposed on the slide.

19. The valve system as recited in claim 18, wherein the third control face of the first main valve is formed by a first end face and is connected to the pilot-control valve.

20. The valve system as recited in claim 18, wherein the first and second control faces of the first main valve are formed by a plurality of annular faces integrally formed on the slide and by the end face.

* * * * *